United States Patent [19]

Büchel

[11] 3,991,925

[45] Nov. 16, 1976

[54] MOVABLY MOUNTED MAGAZINE FOR FEEDING FASTENING ELEMENTS INTO A SETTING GUN BARREL

[75] Inventor: Franz Büchel, Rugell, Liechtenstein

[73] Assignee: Hilti Aktiengesellschaft, Schaan, Liechtenstein

[22] Filed: July 9, 1975

[21] Appl. No.: 594,340

[30] Foreign Application Priority Data

July 12, 1974 Germany ..... 2433642

[52] U.S. Cl. ..... 227/10; 227/120

[51] Int. Cl.[2] ..... B25C 1/14

[58] Field of Search ..... 227/8, 9, 10, 95, 96, 227/97, 114, 136

[56] References Cited

UNITED STATES PATENTS

| | | | |
|---|---|---|---|
| 3,266,697 | 8/1966 | Fiedler | 227/120 |
| 3,632,032 | 1/1972 | Termet | 227/10 |
| 3,670,942 | 6/1972 | Pomeroy | 227/10 |

*Primary Examiner*—Granville Y. Custer, Jr.
*Attorney, Agent, or Firm*—Toren, McGeady and Stanger

[57] ABSTRACT

In a setting gun for driving fastening elements into a hard receiving material, a magazine for feeding fastening elements into the setting gun barrel is pivotally mounted on the barrel. The magazine has an outlet opening through which the fastening elements pass into an inlet opening into the barrel bore. When the setting gun is in condition to be fired the magazine is locked from movement which would permit alignment between its outlet opening and the inlet opening to the barrel bore. By axially displacing the barrel out of the firing condition to overcome the locking action, the magazine can be pivoted for registering its outlet opening with the barrel bore inlet opening for feeding a fastening element into the bore.

13 Claims, 5 Drawing Figures

MOVABLY MOUNTED MAGAZINE FOR FEEDING FASTENING ELEMENTS INTO A SETTING GUN BARREL

SUMMARY OF THE INVENTION

The present invention is directed to a magazine for use with a setting gun which drives fastening elements into a hard receiving material and, more particularly, it concerns a magazine which is pivotally mounted on the barrel of the setting gun and has a surface which forms a portion of the guiding surface in the barrel which guides the fastening elements as they are driven from the gun.

In setting guns which use an exposive charge for driving fastening elements into a hard receiving material, it is necessary that the fastening elements are adequately guided on all sides as they are driven from the barrel of the gun. It is only with complete lateral guidance of the fastening elements that it is possible for them to attain optimum holding values.

In setting guns used for inserting fastening elements into wood and other similar soft receiving materials, compressed air is frequently used as the driving means and it has been known to use magazines rigidly connected with the gun barrel. In such guns, the barrel has a permanently opened recess which permits individual fastening elements to enter the barrel from the magazine. Due to the recess, the barrel does not provide complete lateral guidance for the fastening elements and this type of gun is only suitable for driving fastening elements into soft receiving materials, because the complete lateral guidance of the fastening elements as they are driven from such guidance is not a determining factor in the effectiveness of the driving operation.

In setting guns used for driving fastening elements into hard receiving materials, the solution to the problem of adequate guidance has been attempted by storing the fastening elements in elaborate magazine constructions. For example, magazines have been known where hollow cylindrical recesses are formed in the magazine which act in combination with the barrel so that the hollow cylindrical recesses form, during the driving operation, a part of the barrel and thereby afford guidance for the fastening elements. Furthermore, band-shaped magazines have been used in which the fastening elements are guided during a major part of the driving operation with the guiding part surrounding the fastening element being separated only from the remainder of the magazine during the final part of the driving step. For example, in such band-shaped magazines the guiding part is separated only when the rear head portion of the fastening element contacts the guiding part. In such magazines there is the problem that a third part must be discharged from the gun when the driving operation is completed. Accordingly, complicated setting gun constructions are frequently required which result in greater susceptibility to problems. Further, another problem is the considerable cost of such magazines because of the material involved, since such magazines usually cannot be reused.

Therefore, the primary object of the present invention is to provide a setting gun for driving fastening elements into a hard receiving material which affords adequate guidance during the driving operations, is not susceptible to operational difficulties, and permits effective storage of the fastening elements and effective movement of the elements into the setting gun barrel.

In accordance with the present invention, the portion of the barrel bore surface serving as a guide for the fastening elements during the driving operation, has an inlet opening for admitting individual fastening elements into the barrrel bore. In addition, a magazine is mounted on the barrel bore and is movably positionable relative to the barrel so that an outlet opening in the magazine can be placed in register with the inlet opening of the barrel and during driving operations with the gun the two openings are displaced out of registration with a part of the magazine closing the inlet opening in the barrel and serving as a part of the guiding surface for the fastening elements.

In accordance with the present invention, the opening into the barrel is open only when fastening elements are being supplied. During the driving operations, the inlet opening is closed so that the fastening elements cannot yield into the magazine where additional elements may be stored. With this arrangement, a reliable guidance of the fastening elements is assured during the driving step. As the magazine or feed duct, a box-shaped member can be pivotally connected to the part of the barrel which guides the fastening elements during driving. The fastening elements can be housed directly in such a magazine or can be added to the magazine or feed duct by means of an additional container. If no container is used, it is also possible to join the fastening elements together in a strip, for example, by means of an adhesive, adhesive tape or the like. If such strips are used, the edges of the inlet and outlet openings serve to separate the inserted fastening element from the remainder of the strip after it is introduced into the barrel.

Biasing means, for example, springs, rubber bands and the like can be used with the magazine for directing the fastening elements toward the barrel. The fastening element feeding operation can be effected by interposing shoes adapted to the contour of the elements.

Preferably, the registration of the inlet and outlet openings can be achieved by pivotally mounting the magazine for movement about an axis extending parallel to the axis of the barrel bore so that the magazine can be pivoted relative to the barrel to register the outlet opening with the inlet opening.

In addition to pivoting the magazine, it is also possible to arrange the magazine for displacement in the axial direction of the barrel to obtain the requisite registration of the openings.

To ensure adequate guidance for a fastening element during the driving operation a part of the magazine forms a closure for the inlet opening in the barrel so that, in effect, it forms a part of the surface of the barrel bore for guiding the fastening element. Normally, this guiding surface provided by the magazine is located adjacent the outlet opening. To provide this guiding effect the surface of the magazine which provides the closure for the inlet opening can be shaped to the contour of the barrel bore or to the contour of the fastening elements used.

It has been found that the concept of the present invention can be advantageously used in setting guns which have a barrel serving as a guide for a driving piston used in inserting the fastening elements and in which the barrel is mounted for axial displacement relative to the housing of the gun. For safety reasons the setting gun can be provided with a locking element so that firing of the gun can be performed only when the outlet opening is displaced out of registration with the inlet opening. This locking element is positioned on the gun so that the pivotal movement of the magazine for aligning the outlet opening with the inlet opening can be carried out only when the gun is not in the firing condition. This arrangement also ensures that there is the required guidance for the fastening element when the gun is fired. With such a locking element, if the two openings are in registration, the barrel can only be moved into the firing position if the magazine is pivoted to offset the outlet opening from the inlet opening.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWING

In the drawing:

FIG. 1*a* is taken along the line I*a*—I*a* shown in FIG. 2*a;*

FIG. 2*a* is a sectional view transverse to the firing direction of the setting gun and taken along the line II*a*—II*a* in FIG. 1*a.

DETAILED DESCRIPTION OF THE INVENTION

In the following description, the forward end of the various parts refers to the end facing in the firing direction and the rearward or trailing end refers to the end facing in the opposite direction from the firing direction.

Figure 1A:
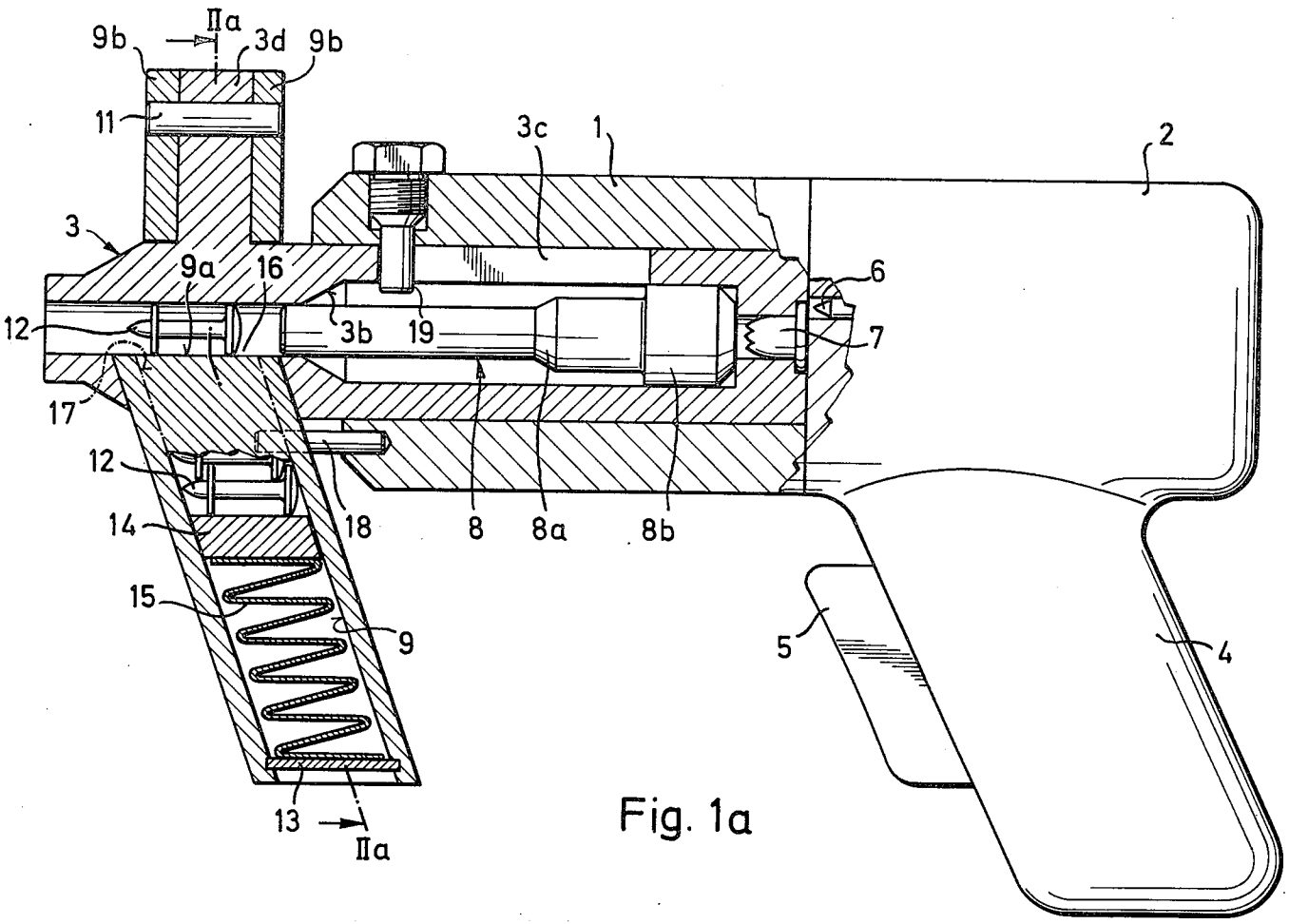
FIG. 1*a* is a side elevational view, partly in section, of a piston-type setting gun embodying the present invention and with the setting gun in the firing condition.
Figure 1B:
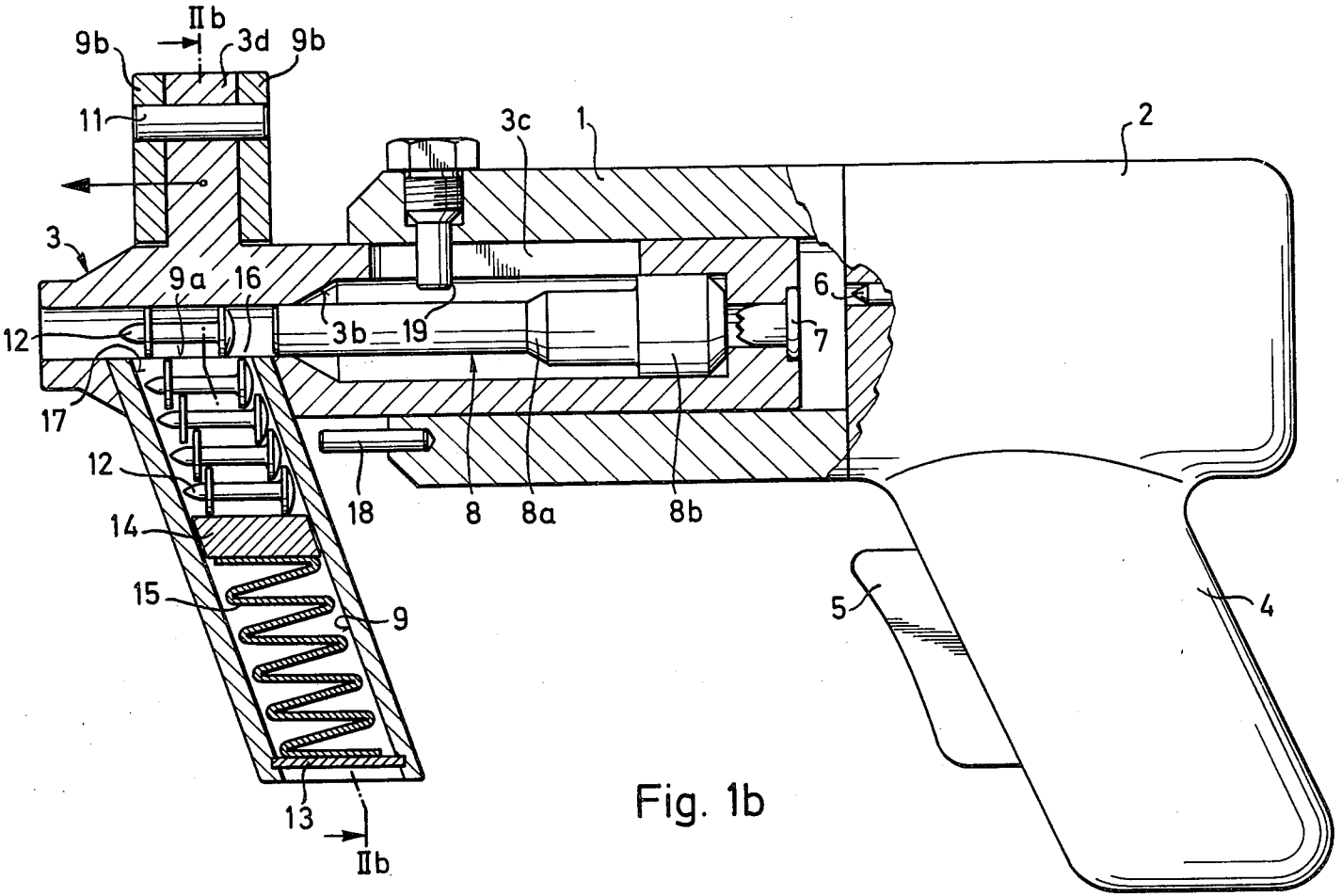
FIG. 1*b* is a view similar to FIG. 1*a*, however, the setting gun is shown displaced from the firing condition with FIG. 1*b* being taken along the line I*b*—I*b* shown in FIG. 26.
Figure 1C:
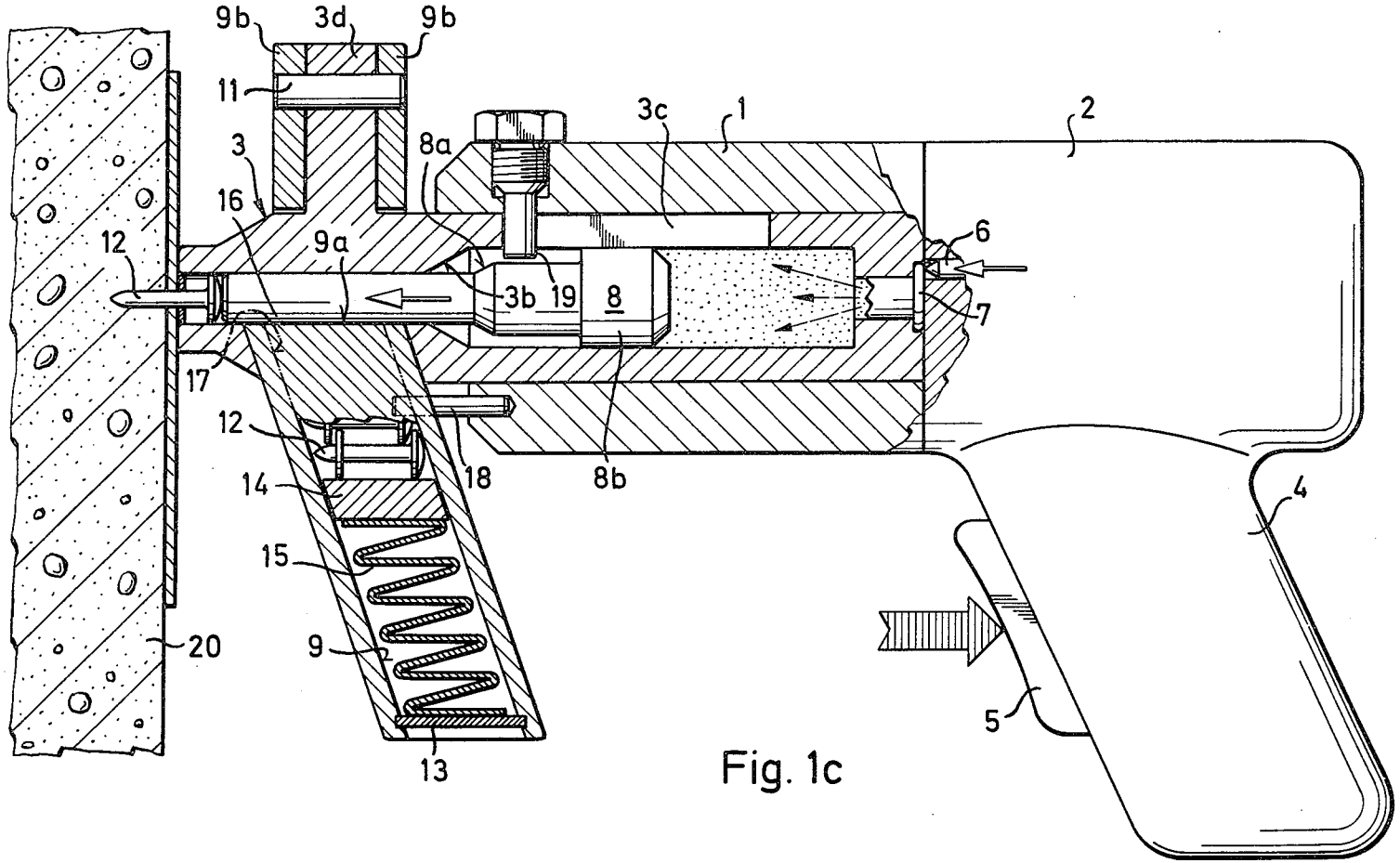
FIG. 1*c* is a view similar to that shown in FIGS. 1*a* and 1*b* but with the setting gun having been fired for driving a fastening element into a receiving material.
Figure 2A:
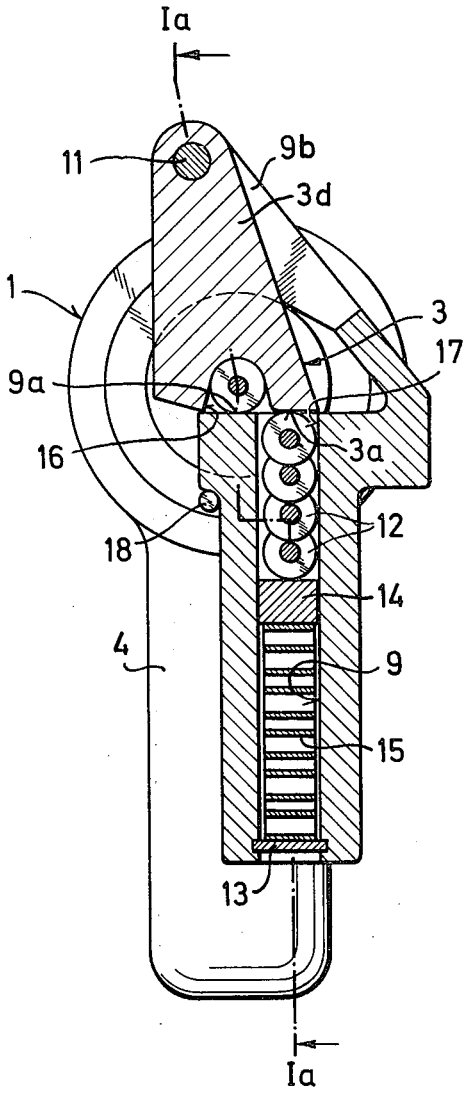
Figure 2B:
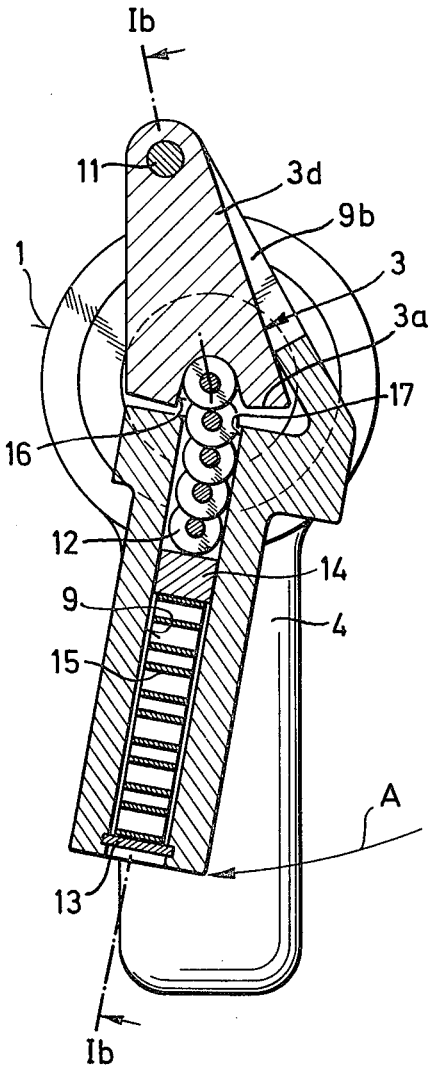
* and FIG. 2*b* is a view similar to FIG. 2*a*, however, taken along the line II*b*—II*b* as shown in FIG. 1*b*.

In FIGS. 1*a*, 1*b* and 1*c* a piston-type setting gun using an explosive charge for driving fastening elements into a receiving material, particularly a hard receiving material, consists of a gun housing having a first forward end part 1 and a second rearward end part 2. The first part 1 has an axially extending bore therethrough open at its forward end and providing a sliding support for a barrel 3 which is movably displaceable relative to the housing. The second housing part 2 includes a handle 4 in which a trigger 5 is positioned for actuating a firing pin 6 in a known manner. This arrangement used for firing a cartridge is well known, accordingly, it is not discussed in detail. When the gun is fired, the trigger 5 releases the firing pin 6, which is located in the second housing part 2, and the pin ignites a cartridge 7 positioned within a chamber at the trailing end of the barrel 3. The barrel 3 has an axially extending bore open at its forward end within which a driving piston 8 is positioned for axial displacement. As can be seen in the drawing and especially in FIGS. 1*a* and 1*c* when the barrel is fully inserted into the first housing part 1, its trailing end contacts the forward end of the second housing part 2 and a certain axial length of the barrel projects forwardly out of the forward end of the first housing part. A magazine 9 is mounted on the portion of the barrel 3 projecting from the end of the housing in FIG. 1*a*. The magazine contains a plurality of fastening elements 12 arranged to be fed, one after the other, into the bore in the barrel 3. In FIGS. 2*a* and 2*b* it can be noted that the magazine 9 is pivotally mounted on the barrel 3. A projection 3*d* extends outwardly from the outer surface of the barrel transversely of the firing direction and a bolt 11 is positioned in the projection. The bolt extends in parallel relation with the axis of the bore through the barrel and a pair of arms 9*b* extend from the magazine and are rotatably secured on the opposite ends of the bolt 11 projecting forwardly and rearwardly from the projection 3*d*.

Within the magazine a passageway is provided containing the fastening elements 12 oriented in the firing direction so that once inserted into the barrel they are in position to be inserted into the receiving material. At the lower end of the passageway through the magazine, that is, the end remote from the barrel bore, a bottom closure member 13 supports a spring which extends upwardly through the passageway into contact with a shoe 14. In the embodiment shown in the drawing the spring 15 is a leaf spring, however, other springs or biasing means can be used for pressing the fastening elements toward the barrel, for instance, coils springs, rubber bands and the like.

As is shown more clearly in FIGS. 2*a* and 2*b*, the barrel 3 has an inlet opening 16 sufficient to pass a fastening element into the barrel bore. Similarly, the magazine 9 has an outlet opening 17 through which a fastening element can be fed from the magazine through the inlet opening 16 into the barrel bore. In FIG. 2*a*, representing the position of the setting gun parts shown in FIG. 1*a*, the outlet opening 17 is displaced laterally from the inlet opening 16 so that it is not possible for the fastening elements to move out of the magazine into the barrel. FIG. 1*a* shows the setting gun in the firing condition, that is with the various parts positioned to ignite a cartridge 7 for propelling the piston through the barrel bore and driving the fastening element 12 into receiving material 20, note FIG. 1*c*. However, if the magazine is pivoted to the position shown in FIG. 2*b* the outlet opening 17 is in register with the inlet opening 16 and one fastening element can be fed into the bore in the barrel 3. After the fastening element has been inserted into the barrel, the magazine 9 is returned to the position shown in FIG. 2*a* where the shoulder or surface 3*a* on the barrel provides a stop preventing the fastening elements from being displaced from the passageway in the magazine by the spring 15.

However, as can be seen in FIG. 1*a*, because of the position of locking element 18 which extends forwardly from the forward end of the housing part 1, the magazine 9 cannot be pivoted to effect registration between its outlet opening 17 and the inlet opening 16 of the barrel. To be able to load a fastening element into the barrel it is necessary to move the barrel forwardly as shown in FIG. 1*b* ahead of the forward end of the locking element 18 so that the pivotal displacement shown by the arrow A in FIG. 2*b* can be performed. When the gun is positioned as shown in FIG. 1*a* it is not possible to pivot the magazine so that a fastening element can be inserted into the barrel and, as can be seen in FIG. 2*a*, the end face surface 9*a* of the magazine effects a closure of the inlet opening to the barrel bore and provides complete lateral guidance of the fastening element. Accordingly, complete lateral guidance of the fastening element is ensured whenever the setting gun is in the firing condition. By comparing FIGS. 2*a* and 2*b* it can be noted that in the firing condition of the gun as shown in FIG. 2*a* the locking element 18 locks the movement of the magazine in the direction A as shown in FIG. 2*b*.

In FIG. 1*b* a fastening element has been inserted into the barrel bore by displacing the magazine pivotally about the bolt 11 from the position shown in FIG. 2*a* to that in FIG. 2*b*. However, since the barrel has been displaced outwardly from the locking element 18 to permit the pivotal movement of the magazine, the trailing end of the barrel has been spaced forwardly from the firing pin 6 in the second housing part 2 and, as a result, the gun is not in the firing condition. With the magazine rotated back to the position of FIG. 2*a* and recessed fully into the first housing part 1, the trailing end of the barrel seats against the forward end of the second housing part 2 so that a cartridge can be ignited. In FIG. 1*b* the arrow extending in the firing direction from the projection 3*d* on the barrel indicates the forward movement that must be effected on the barrel relative to the housing to assure loading of a fastening element into the barrel.

With the setting gun in the firing condition as shown in FIG. 1*a* by depressing the trigger 5, note the arrow in FIG. 1*c*, the firing pin is released and it ignites the cartridge 7 in the chamber in the trailing end of the barrel 3. The explosive gases generated by the ignition of the cartridge propel the piston forwardly through the barrel with its forward end contacting the fastening element and driving it through a plate-like member into the receiving material 20, note FIG. 1*c*. During the propulsion of the piston 8 through the barrel 3 it travels forwardly until shoulder 8*a* on the piston contacts the correspondingly shaped diameter restriction 3*b* in the barrel.

To return the setting gun to the firing condition, after the completion of a fastening element driving cycle, the barrel 3 is pulled forwardly out of the first housing part 1 and, due to a stop 19 mounted in the housing part 1 and extending through the axially extending slot 3*c* in the barrel, the stop contacts the forward shoulder on the head portion 8*b* of the piston 8 and causes the piston to move rearwardly relative to the barrel until the forward movement of the barrel is checked by the contact of the trailing end of the groove or slot 3*c* against the stop 19. With the piston returned to the rearward end of the barrel 3, as in FIGS. 1*a* and 1*b*, the portion of the barrel bore in the range of the magazine outlet opening 17 is open and free to receive a fastening element 12. With the barrel pulled out of the first housing part 1 a sufficient distance to clear the locking element 18, the magazine can be pivoted about the shaft 11 in the direction of the arrow A in FIG. 2*b* until the outlet opening 17 registers with the inlet opening 16 and the spring 15 pushes the fastening element located at the outlet opening 17 into the bore in the barrel. As mentioned above, while the gun is in the condition as shown in FIG. 1*b* of the magazine located forwardly of the locking element, the cartridge 7 is spaced from the forward face of the rear housing part 2 and ignition of a cartridge is not possible.

After the magazine has been returned to the position shown in FIG. 2*a* so that the end face surface 9*a* provides a part of the guide surface within the barrel bore, the magazine and the barrel can be returned to the position of FIG. 1*a*, that is the firing condition of the gun. In this condition the gun is ready to fire another fastening element 12 into the receiving material 20.

While a specific embodiment of the invention has been shown and described in detail to illustrate the application of the inventive principles, it will be understood that the invention may be embodied otherwise without departing from such principles.

What is claimed is:

1. A setting gun using an explosive charge for driving fastening elements into a hard receiving material comprising a housing having an axially extending bore therethrough, a barrel axially displaceably mounted in the bore of said housing and said barrel having an axially extending bore therethrough in parallel relation with the housing bore, the surface of the bore in said barrel affording a guide surface for fastening elements as the elements are driven from the bore, said bore in said barrel having a forward end from which fastening elements are driven into the receiving material and a trailing end, an inlet opening in the lateral surface of said barrel for inserting a fastening element into said barrel bore, wherein the improvement comprises a magazine having a passageway therethrough arranged to contain a plurality of fastening elements in position to be inserted individually out of the magazine and into said barrel bore, said magazine having an outlet opening from the passageway extending in the axial direction of the barrel bore through which the fastening elements can be passed into the barrel bore, said magazine being movably mounted on said barrel with the passageway therein extending transversely of and outwardly from the axis of said barrel, said magazine being movably mounted for movement around said barrel between a first position with the outlet opening in said magazine in register with the inlet opening into said barrel bore and a second position with the outlet opening displaced from the inlet opening and with said magazine blocking the passage of the fastening elements into the barrel bore.

2. A setting gun, as set forth in claim 1, wherein said magazine is pivotally mounted on said barrel for pivotal movement about an axis disposed in parallel relation with the axis of said barrel bore.

3. A setting gun, as set forth in claim 2, wherein the pivot axis of said magazine is spaced radially outwardly from the axis of said barrel bore.

4. A setting gun, as set forth in claim 3, wherein the passageway in said magazine containing said fastening elements is located on one side of the barrel and the pivot axis of said magazine is spaced on the diametrically opposite side of the barrel.

5. A setting gun, as set forth in claim 2, wherein said magazine in the second position forms a closure for the inlet opening in said barrel and also affords a continuation of the guide surface within said barrel bore.

6. A setting gun, as set forth in claim 5, wherein said magazine has an end wall surface defining one side of the outlet opening from the passageway therein and said end wall surface forms the closure for the inlet opening to said barrel bore and the continuation of the guide surface of said barrel bore.

7. A setting gun, as set forth in claim 3, wherein said barrel having a forward end facing in the firing direction and an oppositely facing trailing end, said barrel being movable relative to said housing from a first position where the trailing end of said barrel bears in surface contact with said housing to at least one second position with the trailing end of said barrel spaced out of surface contact with said housing, said barrel having an outer surface which slidingly engages said housing bore, said barrel having an axial length projecting outwardly from the housing bore when the barrel is in the first position, said axial length of said barrel containing the inlet opening to said barrel bore, and a projection on said barrel and extending transversely of its axis and outwardly from the outer surface of the barrel in the range of said axial length thereof.

8. A setting gun, as set forth in claim 7, wherein a pin is mounted in said projection outwardly from the outer surface of said barrel with said pin disposed in parallel relation with the axis of said barrel bore and forming the pivot axis for said magazine, and said magazine having at least one arm pivotally mounted on said pin for pivoting said magazine between its first and second positions.

9. A setting gun, as set forth in claim 5, wherein spring means are mounted in the passageway in said magazine for biasing the fastening elements therein toward said outlet opening.

10. A setting gun, as set forth in claim 7, wherein lock means are provided on the setting gun for preventing registration between said outlet opening from the passageway in said magazine and said inlet opening to said barrel bore when said barrel is in the first position.

11. A setting gun, as set forth in claim 10, wherein said lock means comprises a locking element mounted on the end of said housing facing in the firing direction of the setting gun and from which said axial length of said barrel projects, said locking element extending forwardly from said housing into the range of said magazine when said barrel is in the first position, said locking element is located in the range of said magazine so that it blocks the pivotal movement of said magazine to prevent registration between the outlet opening of the magazine and the inlet opening to said barrel bore.

12. A setting gun, as set forth in claim 1, wherein a piston is displaceably mounted within said barrel bore for driving fastening elements from said barrel bore, means mounted in said housing and extending into the path of movement of said barrel within said housing bore for limiting the extent said barrel is axially displaceable relative to said housing and also for displacing said piston through said barrel for returning said piston into position for firing the setting gun.

13. A setting gun, as set forth in claim 7, wherein said barrel forming a cartridge chamber in its trailing end in communication with the bore in said barrel, a firing pin mounted in said housing and arranged to strike a cartridge position in said cartridge chamber when said barrel is in the first position.

* * * * *